United States Patent [19]

Ishi et al.

[11] 4,035,908

[45] July 19, 1977

[54] METHOD OF MANUFACTURING ELECTRIC MOTOR COMMUTATOR

[75] Inventors: Hirohisa Ishi; Koichiro Hukui; Norikatsu Inoue, all of Tokyo, Japan

[73] Assignee: Sony Corporation, Tokyo, Japan

[21] Appl. No.: 717,589

[22] Filed: Aug. 25, 1976

[30] Foreign Application Priority Data

Oct. 29, 1975 Japan ..... 50-130202

[51] Int. Cl.[2] ..... H01R 43/08

[52] U.S. Cl. ..... 29/597; 29/424; 310/236; 427/125; 427/126; 427/357

[58] Field of Search ..... 29/597, 424; 310/233, 310/235, 236, 237, 45; 427/123-126, 356, 357, 156, 405, 419 R, 419 A

[56] References Cited

U.S. PATENT DOCUMENTS

| | | | |
|---|---|---|---|
| 1,768,654 | 7/1930 | Apple | 310/235 |
| 3,103,060 | 9/1963 | Fay | 29/597 |

*Primary Examiner*—Carl E. Hall

*Attorney, Agent, or Firm*—Lewis H. Eslinger; Alvin Sinderbrand

[57] ABSTRACT

In manufacturing an electric motor commutator which includes a cylindrical insulator having an axial bore for receiving the shaft of an electric motor, and a plurality of segments of commutator metal, such as, copper, extending about the outer circumferential surface of the insulator and being spaced apart by axially extending slots opening radially outward from the insulator between confronting surfaces of adjacent segments; the circumferential surfaces of the segments are shielded, as by plating the same with a metal other than the commutator metal, such as, silver, nickel, tin or zinc, or by coating such circumferential surfaces with a paint, whereupon, the resulting commutator assembly is oxidized so that only the confronting surfaces of the segments between which the slots are defined are covered with insulating layers of copper oxide, and then the shielding, along with any oxide that may have been formed thereon, is removed from the circumferential surfaces of the segments for exposing the copper or other commutator metal at such circumferential surfaces. Preferably, the commutator segments are formed by cutting the slots in a sleeve of the commutator metal which extends around the cylindrical insulator, with the cutting of the slots being effected after the outer circumferential surface of the sleeve has had the shielding, that is, the metal plating or paint, applied thereto.

9 Claims, 6 Drawing Figures

METHOD OF MANUFACTURING ELECTRIC MOTOR COMMUTATOR

BACKGROUND OF THE INVENTION

1. Field of the Invention

This invention relates to a method of manufacturing a commutator for an electric motor, and more particularly is directed to an improved method of manufacturing an electric motor commutator in which a plurality of commutator segments of copper or the like extend about the outer circumferential surface of a cylindrical insulator and are spaced apart by axially extending slots opening radially outward from the insulator between confronting surfaces of the adjacent segments.

2. Description of the Prior Art

In small-sized DC electric motors, such as are used for tape recorders, it is known to employ a commutator which includes a cylindrical insulator having an axial bore for receiving the rotory motor shaft, and a plurality of copper commutator segments which extend about the outer circumferential surface of the insulator and are spaced apart by axially extending slots opening radially outward from the insulator between confronting surfaces of the adjacent commutator segments. During operation of a DC electric motor of the described type, the friction between the commutator segments and the brushes engaging the same produces a conductive powder, for example, by erosion of the carbon brushes, and such conductive powder accumulates in the slots between the adjacent commutator segments. As a result of the accumulation of conductive powder in the slots, the insulation between the adjacent commutator segments deteriorates and the operating efficiency of the electric motor is decreased. Finally, the accumulated conductive powder in the slots may cause shorting of the adjacent commutator segments with the result that the useful life of the electric motor is curtailed.

OBJECTS AND SUMMARY OF THE INVENTION

Accordingly, it is an object of this invention to provide a commutator for an electric motor, as described above, in which the insulation between adjacent commutator segments is maintained even when a conductive powder accumulates in the slots separating such commutator segments.

More specifically, it is an object of the invention to provide a commutator for an electric motor, as described above, in which the confronting surfaces of adjacent commutator segments between which the radially opening slots are defined have insulating oxide coatings thereon so that, even when conductive powder accumulates in such slots, the insulating oxide coatings maintain the insulation between adjacent commutator segments.

Another object of the invention is to provide a method by which an electric motor commutator, as aforesaid, can be easily manufactured.

In accordance with an aspect of this invention, in manufacturing an electric motor commutator which includes a cylindrical insulator, and a plurality of segments of commutator metal, such as, copper, extending about the insulator and being spaced apart by axially extending slots opening radially outward from the insulator between confronting surfaces of the adjacent segments; the circumferential surfaces of the copper commutator segments are shielded, for example, by being plated with a metal, such as, silver, nickel, tin or zinc, forming a relatively easily removable oxide, or by being coated with paint, whereupon the resulting assembly is oxidized so that only the confronting surfaces of the commutator segments between which the slots are defined have insulating layers of copper oxide forming thereon, and finally the shielding, along with any oxide that may have been formed thereon, is removed from the circumferential surfaces of the commutator segments for exposing the copper or other commutator metal at such circumferential surfaces.

In preferred embodiments of the invention, the commutator segments are provided on the cylindrical insulator by applying a sleeve of copper or other commutator metal over the outer circumferential surface of the insulator, and cutting the slots through the sleeve at least down to the outer circumferential surface of the insulator only after the outer surface of the sleeve has been plated with silver, nickel, tin or zinc, or coated with paint so as to provide the desired shielding only on the circumferential surfaces of the commutator segments which result from the cutting of the slots in the sleeve.

The above, and other objects, features and advantages of this invention, will become apparent from the following detailed description of illustrative embodiments of the invention which is to be read in connection with the accompanying drawing.

DESCRIPTION OF THE PREFERRED EMBODIMENTS

Figure 1:
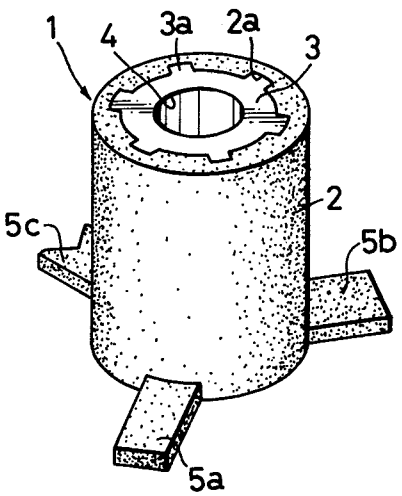

Referring to the drawings in detail, and initially to FIG. 1 thereof, it will be seen that, in manufacturing a commutator for an electric motor by a method embodying this invention, an initial commutator assembly 1 is formed by applying a sleeve 2 of copper or other commutator metal over a cylindrical insulator 3 of synthetic resin. The cylindrical insulator 3 is shown to have an axial bore 4 for receiving the rotary shaft (not shown) of an electric motor. Further, as shown, the outer circumferential surface of the insulator 3 is preferably formed with axial splines *3a* which are received in or mate with corresponding grooves *2a* directed axially along the inner surface of copper sleeve 2. The initial assembly 1 is completed by terminal members *5a*, *5b* and *5c* of copper which may be formed integrally with sleeve 2 and which are directed radially outward from one end of the sleeve with equal angular spacing between the terminal members.

Figure 3:
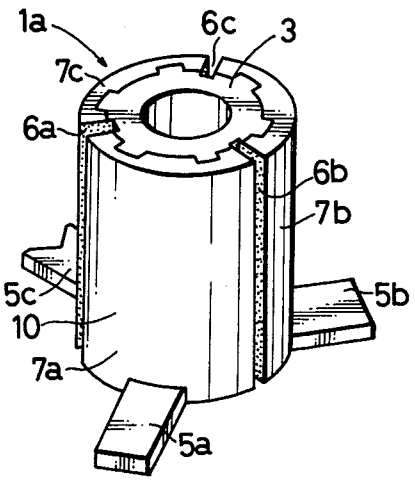
FIGS. 1, 2 and 3 are perspective views illustrating respective steps in the manufacturing of a commutator for an electric motor according to an embodiment of the invention.
Figure 2:
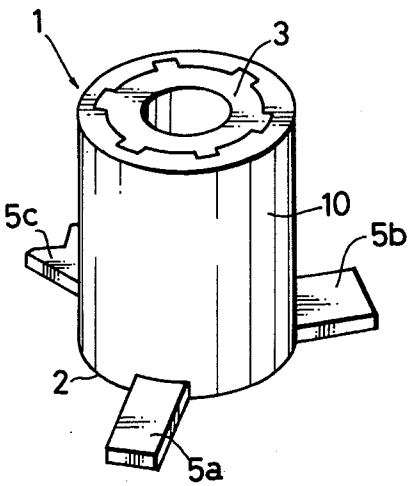

In the next step of the method embodying this invention, all of the exposed surfaces of the copper sleeve 10 and the terminal members *5a*, *5b* and *5c* are silver plated so as to provide a silver coating or layer 10 on such surfaces, as shown on FIG. 2. Thereafter, a plurality of equally spaced apart, axially extending slots 6a, 6b and 6c are cut radially through the silver coating or layer 10 and through the underlying copper sleeve 2 at least down to the outer circumferential surface of cylindrical insulator 3, and preferably slightly into the latter, so as to divide the copper sleeve 2 into a plurality of commutator segments 7a, 7b and 7c which are spaced from each other by the slots 6a, 6b and 6c, as shown on FIG. 3.

Figure 4:
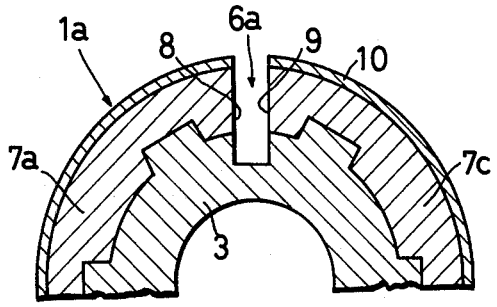
FIG. 4 is a fragmentary, enlarged cross-sectional view of the commutator at the stage of the method according to this invention illustrated by FIG. 3.

As is shown on FIG. 4 in respect to the commutator segments 7a and 7c of the resulting assembly 1a, each of those commutator segments 7a and 7c has its outer circumferential surface covered by the coating or layer 10 of plated silver, whereas, at the confronting surfaces 8 and 9 of the segments 7a and 7c between which the axial slot 6a opens radially outward, the copper of the commutator segments 7a and 7c is exposed. Similarly, in the assembly 1a, copper is exposed only at the confronting surfaces of segments 7a and 7b defining the slot 6b and at the confronting surfaces of segments 7b and 7c defining slot 6c.

After the cutting of the slots 6a, 6b and 6c to form the separated commutator segments 7a, 7b and 7c, the resulting assembly 1a is subjected to an oxidizing treatment. Such oxidizing treatment may be effected by washing the surfaces of assembly 1a with trichloroethylene for removing oil therefrom, followed by washing with hydrochloric acid, whereupon the assembly 1a is immersed in an alkaline solution of potassium persulfate at a temperature of about 100° C. for about 5 minutes to effect the desired oxidizing and, finally, the resulting oxidized assembly 1b (FIG. 5) is thoroughly rinsed with water.

Figure 5:
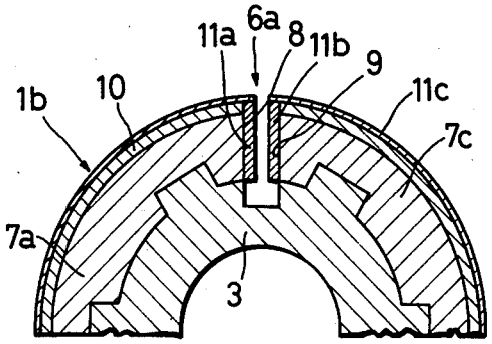
FIG. 5 is a view similar to that of FIG. 4, but illustrating a further step in the method according to this invention.

As is shown on FIG. 5, the assembly 1b that results from the above oxidizing treatment has relatively thick, hard copper oxide films 11a and 11b formed on the opposed surfaces 8 and 9 of each of the slots 6a, 6b and 6c, whereas relatively thin, soft, silver-oxide films 11c are formed on the plated silver layers 10 which cover the circumferential surfaces of commutator segments 7a, 7b and 7c.

Figure 6:
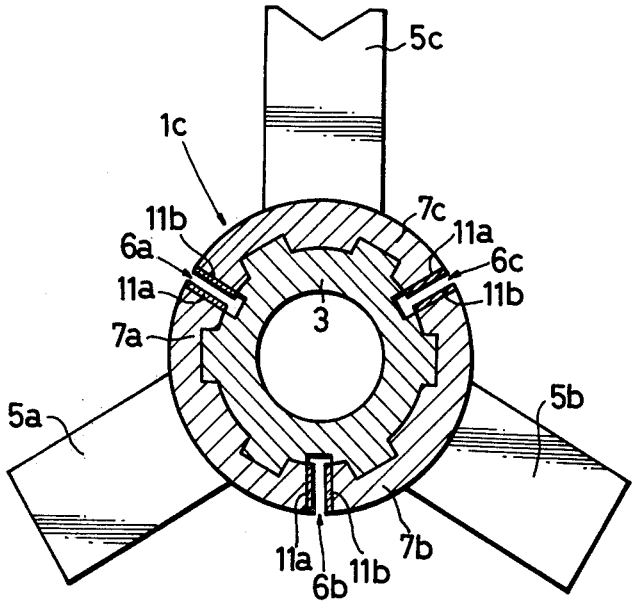
FIG. 6 is an enlarged cross-sectional view of a completed commutator for an electric motor manufactured by the method according to this invention.

Finally, the coatings or layers 10 of plated silver and the respective relatively thin films 11c of silver oxide thereon are cut away from the circumferential surfaces of commutator segments 7a, 7b and 7c, for example, by means of a diamond tool, so as to expose the underlying copper at such circumferential surfaces, and the exposed copper circumferential surfaces of the commutator segments are then ground and buffed to a mirror finish so as to provide the completed commutator 1c, as shown on FIG. 6. Since the plated silver layers 10 and the films 11c of silver oxide thereon are relatively soft, the diamond tool used for cutting away or removing such layers and films is only lightly loaded to reduce the wear of such tool and to permit the infrequent exchanging thereof. On the other hand, if the shielding layers 10 of plated silver had not been provided on the outer circumferential surfaces of commutator segments 7a, 7b and 7c prior to the above described oxidizing treatment, then such treatment would have resulted in the deposit of relatively thick, hard copper oxide layers on the circumferential surfaces of the commutator segments as well as on the confronting surfaces thereof between which the slots 6a, 6b and 6c are defined. Such relatively thick, hard copper oxide layers, if provided on the circumferential surfaces of the commutator segments, would be removable therefrom only with considerable difficulty and at the cost of frequent changing of the diamond tool employed therefor.

In the completed commutator 1c according to this invention, the silver oxide films on the terminal members 5a, 5b and 5c may be cut or ground away to expose copper at the surfaces thereof. However, since the silver oxide films on terminal members 5a, 5b and 5c are conductive and solderable, the silver oxide films on the terminal members do not have to be cut or ground away to expose copper surfaces thereon.

It will be apparent that, when the completed commutator 1c manufactured in accordance with this invention is employed in an electric motor, the insulating copper oxide films 11a and 11b which cover the confronting surfaces of the adjacent commutator segments at the opposite sides of each of the slots 6a, 6b and 6c ensure that, even when a conductive powder resulting from friction between the commutator segments 7a, 7b and 7c and the brushes contacting the same accumulates in the slots 6a, 6b and 6c, the electrical insulation between the commutator segments 7a, 7b and 7c will be maintained. Thus, an electric motor having a commutator manufactured in accordance with this invention will continue to have a high operating efficiency even after a long period of use, and its useful life will be extended.

In the method according to this invention, as described above, the shielding layer or coating 10 on the circumferential surfaces of the commutator segments 7a, 7b and 7c is preferably formed of silver, as silver is most easily plated on the copper sleeve 2 and the copper terminal members 5a, 5b and 5c. Further, silver is preferred for the shielding coating or layer 10 by reason of the fact that silver and its oxide are conductive and readily soldered and thus do not need to be removed from the terminal members 5a, 5b and 5c when effecting connections with the latter, and also by reason of the fact that the silver coating 10 and the film of silver oxide 11c thereon can be most easily cut or otherwise removed from the circumferential surfaces of the commutator segments 7a, 7b and 7c. However, in the method according to this invention, the shielding coating or layer 10 plated on the copper sleeve 2 and the terminal members extending from the latter may be formed of nickel, tin or zinc, rather than of silver as in the above described embodiment.

In accordance with another embodiment of this invention, the shielding coating or layer 10 applied to the copper sleeve 2 and terminal members 5a, 5b and 5c prior to the cutting of the slots 6a, 6b and 6c may be formed of a paint which is effective to prevent oxidation of the underlying copper surfaces when the commutator assembly 1a is subjected to the previously described oxidizing treatment. After such oxidizing treatment, which results in the forming of the copper oxide films or layers 11a and 11b at the opposite sides of each of the slots 6a, 6b and 6c, the paint coating the circumferential surfaces of the commutator segments 7a, 7b and 7c and the terminal members 5a, 5b and 5c is either mechanically or chemically removed therefrom so as to provide the completed commutator 1c, as shown on FIG. 6.

Although illustrative embodiments of the method according to this invention have been described in detail herein with reference to the accompanying drawing, it is to be understood that the invention is not limited to those precise embodiments, and the various changes and modifications may be effected therein by one skilled in the art without departing from the scope or spirit of the invention as defined in the appended claims.

We claim:

1. In the method of manufacturing an electric motor commutator from an assembly which includes a cylindrical insulator, and a plurality of segments of commutator metal extending about the outer circumferential surface of the insulator and being spaced apart by axially extending slots opening radially outward from the insulator between confronting surfaces of the adjacent segments; the steps of shielding the circumferential surfaces of said segments, subjecting said assembly to an oxidizing treatment with said shielding on said circumferential surfaces of the segments so that only said confronting surfaces of the segments between which said slots are defined have layers of an oxide of said commutator metal formed thereon, and then removing said shielding from said circumferential surfaces of the segments for exposing said commutator metal at said circumferential surfaces of the segments.

2. The method according to claim 1; in which said segments are provided on the cylindrical insulator by applying a sleeve of said commutator metal over said outer circumferential surface of the insulator, and then cutting said slots through said sleeve at least down to said outer circumferential surface of said insulator.

3. The method according to claim 2; in which said shielding is applied to the outer circumferential surface of said sleeve prior to said cutting of the slots through said sleeve.

4. The method according to claim 3; in which said shielding is applied by plating said outer circumferential surface of the sleeve with a metal which is different from said commutator metal, and which, when oxidized, is relatively easily removed from said circumferential surfaces of the segments.

5. The method according to claim 4; in which said plating metal is selected from the group consisting of silver, nickel, tin and zinc, and said commutator metal is copper.

6. The method according to claim 4; in which said plating metal is silver, and said commutator metal is copper.

7. The method according to claim 3; in which said shielding is applied by coating said outer circumferential surface of the sleeve with a paint.

8. The method according to claim 3; in which said outer circumferential surface of said insulator and the inner surface of said sleeve have mating splines and grooves.

9. The method according to claim 2; in which said slots are cut inwardly beyond said outer circumferential surface of the insulator.

* * * * *